US010144567B2

(12) United States Patent
Schloesser et al.

(10) Patent No.: US 10,144,567 B2
(45) Date of Patent: Dec. 4, 2018

(54) SHRINK PACKAGING

(71) Applicant: DIOPASS SPRL, Jalhay (BE)

(72) Inventors: Henry Frederic Schloesser, Jalhay (BE); Paula Mireille Fluzin, Jalhay (BE)

(73) Assignee: DIOPASS SPRL, Jalhay (BE)

( * ) Notice: Subject to any disclaimer, the term of this patent is extended or adjusted under 35 U.S.C. 154(b) by 41 days.

(21) Appl. No.: 14/415,569

(22) PCT Filed: Jul. 19, 2013

(86) PCT No.: PCT/EP2013/065265
§ 371 (c)(1),
(2) Date: Jan. 16, 2015

(87) PCT Pub. No.: WO2014/013046
PCT Pub. Date: Jan. 23, 2014

(65) Prior Publication Data

US 2015/0197384 A1 Jul. 16, 2015

(30) Foreign Application Priority Data

Jul. 20, 2012 (BE) ..... 2012/0507

(51) Int. Cl.
*B65D 75/00* (2006.01)
*B65D 71/08* (2006.01)
(Continued)

(52) U.S. Cl.
CPC ..... *B65D 71/08* (2013.01); *B65B 35/44* (2013.01); *B65B 41/00* (2013.01); *B65B 41/12* (2013.01);
(Continued)

(58) Field of Classification Search
CPC .. B65D 75/002; B65D 75/006; B65D 71/063; B65D 71/08; B65D 71/34; B31B 19/90; B65B 61/02
(Continued)

(56) References Cited

U.S. PATENT DOCUMENTS 3,750,876 A * 8/1973 Throberg ..... B65D 71/10 206/432
3,834,525 A * 9/1974 Morgese ..... B65D 71/08 206/161
(Continued)

FOREIGN PATENT DOCUMENTS

FR 2 387 172 A1 11/1978
NL 1 005 648 C2 9/1998
(Continued)

OTHER PUBLICATIONS

International Search Report for PCT/EP2013/065265 mailed Oct. 2, 2013.

*Primary Examiner* — Steven A. Reynolds
(74) *Attorney, Agent, or Firm* — Koppel, Patrick, Heybi & Philpott

(57) ABSTRACT

The invention relates to shrink packaging for packing a series of containers. The packaging is characterized in that at least one incision line is provided in a first zone, said incision line including a series of perforations forming at least one partially detachable section arranged to allow the extraction of at least one container in a direction extending substantially from the lower part of the container to the upper part thereof, said partially detachable packaging section being larger than the cross-section of the at least one container to be extracted. Moreover, the partially detachable section is located on the periphery of the first zone.

14 Claims, 3 Drawing Sheets

(51) Int. Cl.

| | |
|---|---|
| ***B65B 61/18*** | (2006.01) |
| ***B65B 41/12*** | (2006.01) |
| ***B65B 35/44*** | (2006.01) |
| ***B65B 41/00*** | (2006.01) |
| ***B65B 53/02*** | (2006.01) |
| ***B65B 61/02*** | (2006.01) |
| ***B65D 21/02*** | (2006.01) |
| ***B65D 75/52*** | (2006.01) |

(52) U.S. Cl.
CPC ..... *B65B 53/02* (2013.01); *B65B 61/025* (2013.01); *B65B 61/18* (2013.01); *B65D 21/0201* (2013.01); *B65D 75/002* (2013.01); *B65D 75/006* (2013.01); *B65D 75/527* (2013.01); *B65D 2301/20* (2013.01); *B65D 2571/00574* (2013.01); *B65D 2571/00679* (2013.01)

(58) Field of Classification Search
USPC ..... 206/497, 432, 427; 383/207, 209
See application file for complete search history.

(56) References Cited

U.S. PATENT DOCUMENTS 4,077,516 A * 3/1978 Duerr ..... B65D 71/0085 206/432
4,333,570 A * 6/1982 Heider ..... B65D 71/10 206/432
4,586,312 A * 5/1986 Limousin ..... B65B 61/02 493/363
4,779,731 A * 10/1988 Fujio ..... B65D 71/08 206/432
5,201,463 A * 4/1993 George ..... B65D 5/4204 206/432
5,630,307 A * 5/1997 Cathala ..... B29C 47/0021 53/398
6,105,776 A * 8/2000 Meilhon ..... B65D 71/08 206/432
8,074,803 B2 * 12/2011 Motsch ..... B65D 75/5833 206/440
8,127,925 B2 * 3/2012 Block ..... B65D 71/10 206/432
2002/0157980 A1 * 10/2002 Sheehan, Jr. ..... B65D 71/08 206/428
2010/0236195 A1 * 9/2010 Kollmuss ..... B65B 11/06 53/441
2011/0215016 A1 * 9/2011 Block ..... B65D 71/40 206/427

FOREIGN PATENT DOCUMENTS

WO WO 99/21775 A1 5/1999
WO WO 99/46180 A1 9/1999

* cited by examiner

SHRINK PACKAGING

The present invention relates to the field of shrinkable packages provided for packing a series of containers comprising an upper portion provided with an aperture and a lower portion corresponding to a bottom, opposite to said upper portion, said containers being arranged in rows parallel with each other, comprising at least one first area for covering an upper portion of said containers, in particular at their opening and a second area covering the underside of said containers at the bottom of said containers, said first area for covering said upper portion of said containers having a central area surrounded by a peripheral area.

This type of packaging is not practical for the consumer who for example wishes to purchase a single container. In this scenario, the consumer is forced to break a portion of the shrink packaging in order to extract the desired container therefrom. The amount of plastic material which is generally used, is provided for protecting and for handling said packaging comprising the containers. However, the packaging is not provided for extracting a certain amount of containers out of said packaging. Therefore, when the consumer breaks a portion of the packaging, the latter is more difficult to displace in the shelves of the shop both by the consumer and the store clerk. Further, when the consumer breaks the packaging, it may then happen that the remainder of the packaging no longer protects or no longer contains a sufficient amount of other containers which are not sufficiently held inside the packaging. The usefulness of this type of packaging is strongly restricted at the present time. Further, often, packaging pieces are torn and detached and land on the ground and thus litter it with not very desirable plastic pieces.

Document US 20110215016 discloses a packaging and a covering element positioned on the upper portion of the cans. The packaging wraps up the containers on which the covering element is positioned which comprises a series of incisions. The covering element comprises a first area provided with a central area surrounded by a peripheral area. The incisions may be present on the central area or on the periphery of said first area of the covering element.

The disclosed packaging allows placement of the cans for example in a fridge. The packaging is therefore positioned so that the opening of the cans is accessible to the consumer who may gradually remove the cans. The principle consists of first tearing the packaging and then breaking the incisions located on the covering element in order to finally access a can. When a can has been removed from the packaging, the covering element gives the possibility of maintaining the structure of the packaging at the openings of the cans in order to facilitate the possible exit of other cans.

Unfortunately, this type of packaging cannot be displaced once one of the incisions has been broken since the packaging no longer sufficiently maintains the remaining cans. This film packaging is difficult to handle during its transport. Therefore, such a packaging is not practical when it is put onto a shelf since the user intending to purchase a single can is forced to break at least one incision which inevitably leads to obtaining a packaging which is no longer capable of sufficiently supporting the remainder of the cans.

Also, the fact that the covering element is also packed by the film may also lead to the removal of the latter by certain consumers intending to have easier access to other cans. Often, it happens that the packagings and the covering elements are left in place on the shelves.

In a shop, it often happens that a consumer breaks a portion of the packaging in order to purchase one or two cans. In this scenario, it is then necessary that the packaging be able to continue to support the remainder of the cans which may be purchased by other consumers who wish to easily and rapidly transport said film packaging without risking instantaneous breaking of this packaging during its handling. The known packaging has a risk of instantaneous tearing which is difficult to control by the consumer or the store clerk.

The disorder is typically not attractive for the consumer who is no longer tempted by these cans and will often then prefer to tear a new packaging in order to pick up the row or the rows which he/she needs. This effect, well-known in supermarkets, requires the continuous presence of handlers in order to tidy up the shelves and pick up the torn packaging portions which are not very effective when they litter the ground. Further, the risk of having the containers positioned in height on pallets fall onto the feet of the consumer or of their children is further an additional reason for making this type of packaging and the product which is contained therein, not attractive for the user.

Further, this type of packaging which requires a film and a covering element and which is provided so that the consumer may extract a can is not practical when it is put on a shelf or put into a fridge since once the packaging has been broken, it is no longer possible to displace the packaging without risking a loss of support for the other cans.

This is why there exists an actual need for providing an improved packaging in terms of support, transport and ease of use. The object of the invention is to overcome the drawbacks of the state of the art by providing a packaging which holds the containers before and after breaking the incisions. Said packaging gives the possibility of facilitating the extraction of a container from the packaging while sufficiently supporting the remainder of the containers during its transport.

In order to solve this problem, according to the invention, a shrink packaging is provided, as indicated at the beginning, characterized in that it comprises on said first area at least one incision line comprising a series of perforations forming at least a partly detachable section arranged for extracting in a direction substantially oriented from the lower portion of the container to the upper portion of at least one container, said partly detachable packaging section having a size greater than or equal to the section of said at least one container to be extracted, said at least partly detachable section being localized at the periphery of said central area of said first area.

The presence of at least one incision line at the periphery of said central area of said first area gives the possibility of providing a packaging which guarantees lateral support around the containers before and after breaking said incision lines.

Within the scope of the present invention, said incision line comprises a series of preparations forming at least one partly detachable section located at the periphery of said central area of said first area, gives the possibility of providing a packaging which protects on the one hand and holds the containers on the other hand, facilitates extraction of a container out of the packaging in a direction substantially oriented from the lower portion of the container to the upper portion by means of the presence of said incision lines located at the periphery of said central area. Further, the localization of at least one partly detachable section at the periphery of said central area of said first area reduces weakening of the remainder of the packaging and also gives the possibility of preserving the strength of the packaging even after tearing said incision lines by preserving a lateral support around the containers. Indeed, when said incision is broken, the peripheral area surrounding said central area is maintained thereby giving the possibility of preserving a shape similar to the initial shape (before breakage). The lateral support allows easy displacement of the containers which are sufficiently held by the packaging which withstands possible deformations which may occur during its displacement. Therefore, the handling of said packaging is facilitated by preserving the strength of the latter even after breaking of said incision by the lateral support of the containers. Further, in the present invention, when a handle is present on the heat-retractable packaging, it is supported on the lateral sides not provided with incision lines which allows easy transport of the packaging comprising all the containers or a portion of the latter. In this way, the packaging may be broken at the incision lines in order to extract a container.

The packaging of the present invention is therefore based on the use of a retractable film which has several advantages whether this be for extracting a container or for easily transporting the whole of the containers.

Advantageously, said partly detachable packaging section is totally detachable. This again gives the possibility of facilitating the extraction of the container present in the packaging.

Preferentially, said peripheral area of said first area (3) covers at least one row of containers on either side of said central area.

In a particular embodiment, said incision line at the periphery of said central area of said first area comprises an initiating portion arranged for facilitating the initiation of said partly detachable packaging section, for example a more dense incision, an opening or a tab. An initiating portion gives the possibility of avoiding the use by the user of his/her own means for breaking the incision line. For example the presence of a tab gives the possibility of facilitating the opening of said packaging at the incision line provided for this purpose.

Preferably, said incision line has a circular, oval, linear, circular arc, square shape with rounded apices, rectangular shape with rounded apices, hexagonal shape with rounded apices or further a finite curve line of irregular shape, allowing extraction of said container out of said partly detachable packaging section.

Preferentially, the containers according to the present invention are selected from the group consisting of cans, cans of food, glass jars, cardboard boxes of the carton or Tetrapack® type. Indeed, globally any type of shape may be provided, provided that partial detachment allows extraction of at least one container from a packaging containing a series of containers.

Other embodiments of the packaging are mentioned in the appended claims.

The present invention also relates to a method for manufacturing a shrink packaging for a series of containers, comprising at least one first area (3) for covering an upper portion of said series of containers (2), in particular at their opening, said first area (3) for covering said upper portion of said containers (2) having a central area surrounded by a peripheral area, said method comprising the steps:

- unrolling a shrink film on a conveyer belt,
- positioning said containers on said conveyer belt, in rows parallel with each other,
- shrink-wrapping said containers by means of said shrink film thereby forming a shrink film packing around said containers, and
- heat-shrinking said shrink film with view to holding the said containers, tightened against each other.

The method according to the invention is characterized in that it further comprises an incision step along a trajectory corresponding to an incision line comprising a series of perforations forming at least one partly detachable section arranged for extracting in a direction substantially oriented from the lower portion of the container to the upper portion, at least one container, said partly detachable packaging section having a size greater than or equal to the section of said at least one container to be extracted, said at least partly detachable section being localized at the periphery of said central area of said first area.

Advantageously, the method according to the invention is characterized in that said incision step is carried out before said unfolding of the shrink film.

In an alternative in the sense of the present invention, said incision is carried out during or after the unfolding of the film, for example before or after said shrinking of said shrink film.

More preferentially, the method according to the invention is characterized in that said incision is carried out by means of a jointed patterned roulette on an arm which may be handled manually in order to mark out said trajectory, by means of a cutter, or by a laser.

Preferably, the method according to the invention further comprises printing of a pattern on said film before said unrolling of said shrink film.

Other embodiments of the method according to the invention are indicated in the appended claims.

The object of the invention is also a shrink packaging blank provided for packing a series of containers, said first area (3) for covering said upper portion of said containers (2) having a central area surrounded by a peripheral area, characterized in that it comprises on the first area at least one incision line comprising a series of preparations forming at least one partly detachable section arranged for extracting in a direction substantially oriented from the lower portion of the container to the upper portion of at least one container, said partly detachable packaging section having a size greater than or equal to the section of said at least one container to be extracted, said at least partly detachable section being localized at the periphery of said central area of said first area.

Advantageously, said partly detachable packaging section is totally detachable.

Preferentially, said incision line at the periphery of said central area of said first area comprises an initiating portion arranged for facilitating the initiation of said partly detachable packaging section, for example a more dense incision, an opening or a tab.

In another embodiment, said incision line has a circular, oval, linear, circular arc, square shape with rounded apices, a rectangular shape with rounded apices, a hexagonal shape with rounded apices or further a finite curved line of irregular shape, allowing extraction of said container out of said partly detachable packaging section.

Advantageously, said containers are selected from the group consisting of cans, food cans, glass jars, cardboard boxes of the carton or Tetrapack® type. Indeed, globally any type of shape may be provided, provided that partial detachment allows extraction of at least one container from a series of containers.

Other embodiments of the shrink packaging blank according to the invention are indicated in the appended claims and figures.

The present invention also relates to an assembly comprising a shrink packaging according to the invention and a series of containers arranged in parallel rows relatively to each other.

Other embodiments of the assembly according to the invention are indicated in the appended claims.

Other features, details and advantages of the invention will become apparent from the description given hereafter, as non-limiting and with reference to the appended drawings.

In the figures, identical or similar elements bear the same references.

Figure 1:
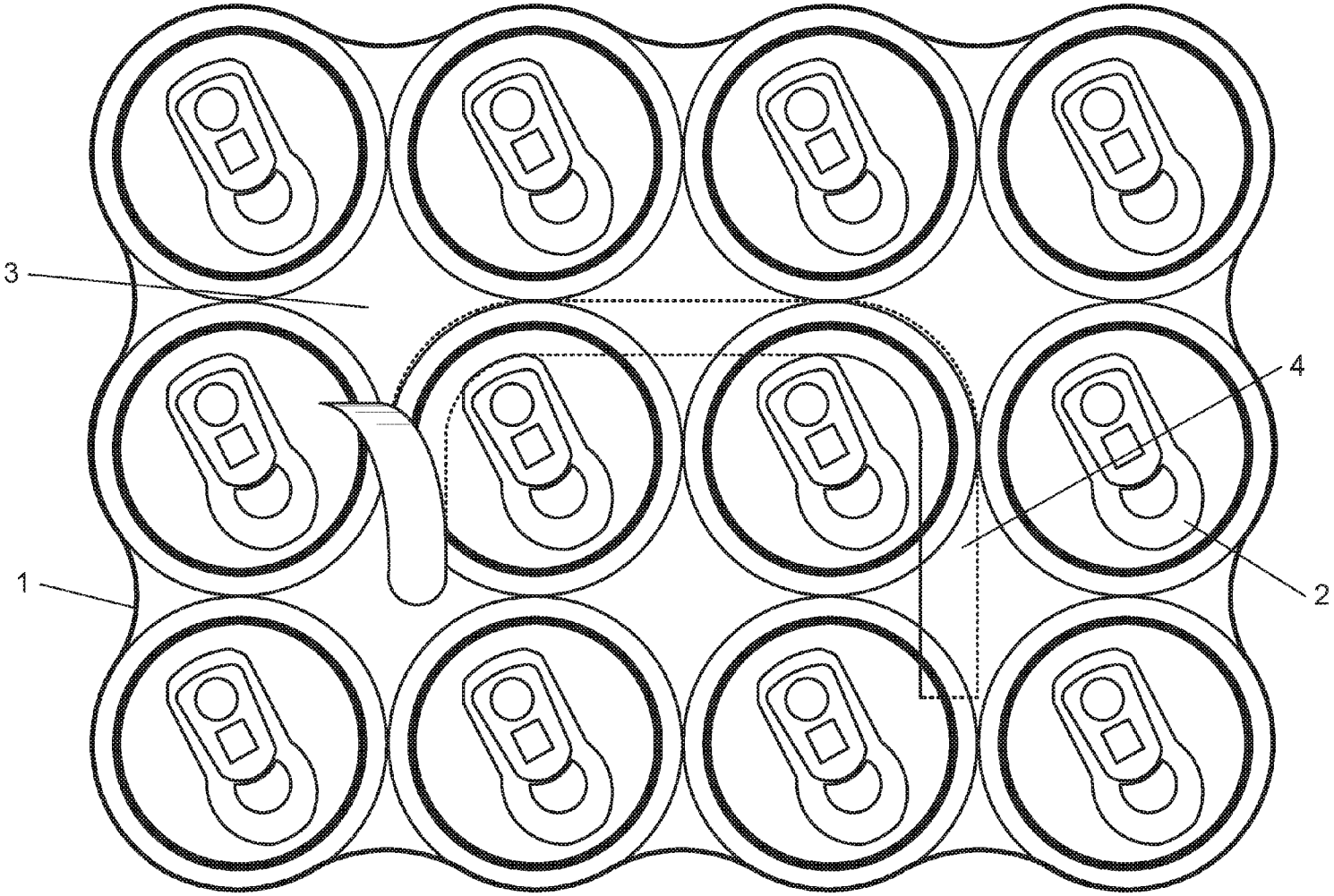
FIG. 1 is a top view of a shrink packaging comprising 12 cans.

FIG. 1 illustrates a shrink packaging 1 comprising twelve cans 2 and a first area 3 located at the opening of said cans. Said first area has a central area and a peripheral area located around said central area. The shrink packaging 1 comprises at the periphery of said central base of said first area 3 an incision line containing a series of perforations which form a partly detachable packaging section 4.

In the sense of the present invention, the incision line comprises, as mentioned earlier, a series of preparations of similar or different shape. The incisions may be of a round, oval, . . . or further rectangular shape, in the form of small bars or any combinations of the latter. Further, said incision line may be a slot for further facilitating extraction of a container.

The preparation of a partly detachable packaging section 4 allows easy access to the cans 2. Next, the remainder of the packaging 1 retains its rigidity since a small amount of plastic material has been broken at the periphery of said central area of said first area 3 of said packaging 1 giving the possibility of carefully preserving the remainder of the cans 2 by means of a lateral support.

By placing the incision line at the periphery of said central area of said packaging 1, it is possible to reduce the risks of breakage at said incisions which may occur during handling (hook, nails present on the shelf, placement on the shelf, palletization, conveyance, . . . ).

Figure 2:
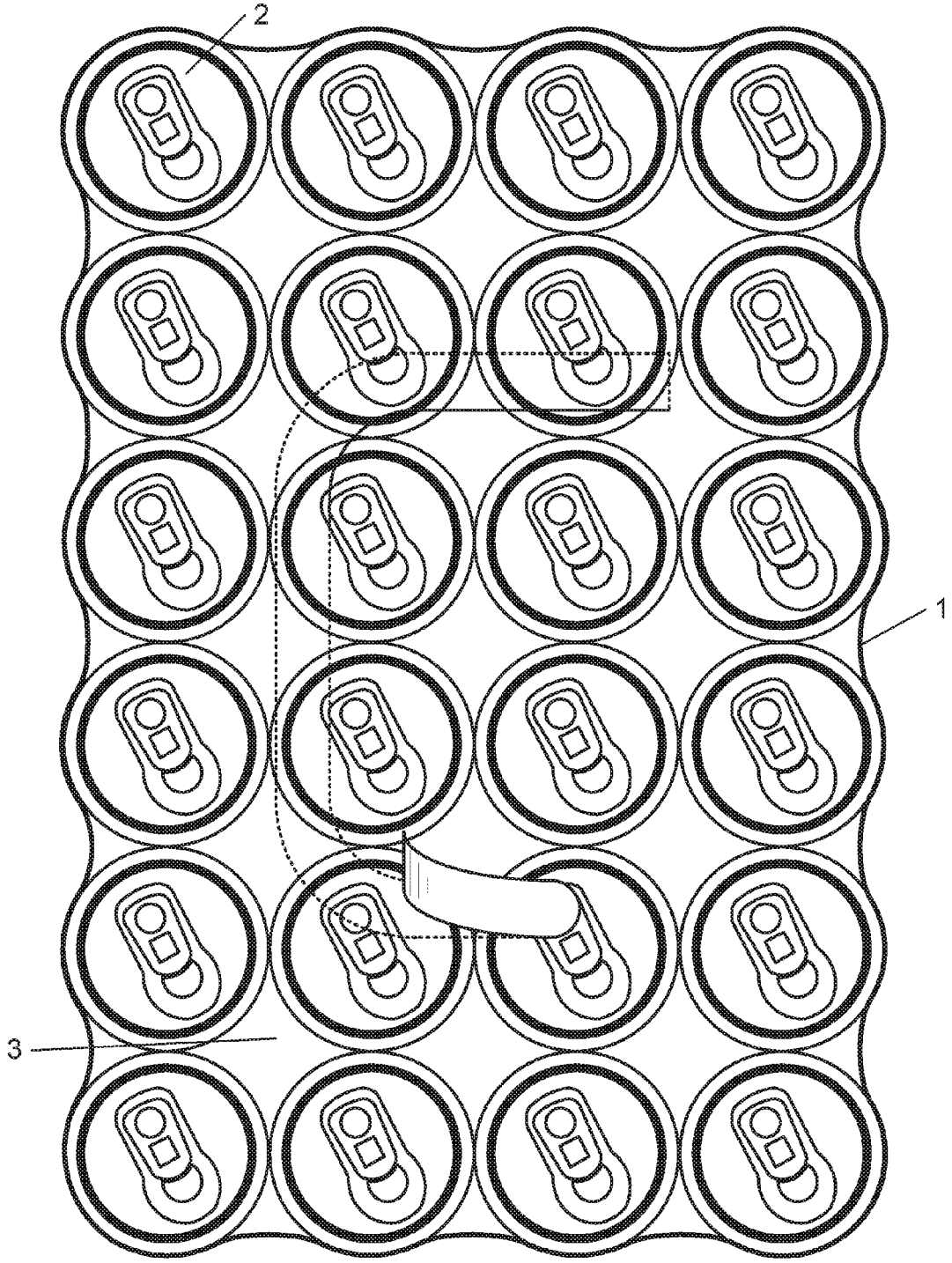
FIG. 2 is a top view of a shrink packaging comprising 24 cans.

FIG. 2 illustrates the same elements as those described in FIG. 1 except that the packaging 1 contains 24 cans.

After breaking the incision line containing a series of preparations defining a partly detachable packaging section 4, the peripheral area subsists around said broken central area. Preservation of said peripheral area gives the packaging sufficient rigidity for handling the remainder of the containers with ease by lateral support of the cans 2.

Figure 3:
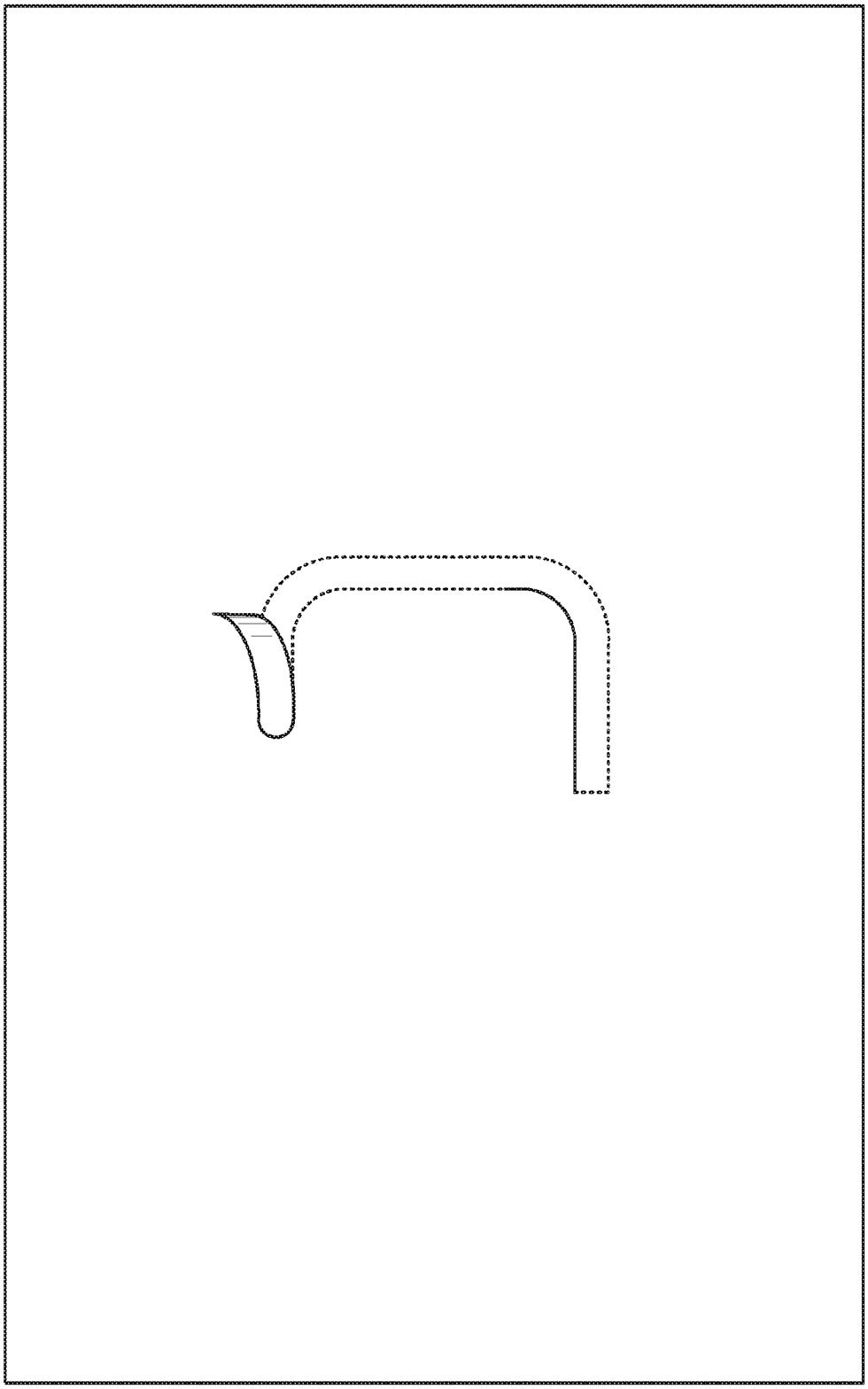
FIG. 3 is a schematic top view illustrating a packaging blank comprising an incision line at the periphery of said central area.

FIG. 3 illustrates a packaging blank according to the invention comprising an incision line comprising a series of perforations forming a partly detachable section 4 located at the periphery of said central area of said first area 3.

The manufacturing of the packaging blank comprises unrolling of a shrink film on a conveyer belt. The shrink film is partly cut beforehand, by means of a patterned roulette, by means of a cutter, or by a laser, in order to delimit a partly detachable packaging section 4 which is localized at the periphery of said central area on the first area 3. Said partly detachable section has a size greater than or equal to the section of a container 2. Next, the containers 2 are positioned in rows parallel with each other on the conveyer belt in order to proceed with their packing. The packing of said containers may be achieved by means of a shrink-wrapper which allows winding of said shrink film perforated beforehand (an incision according to FIG. 3) thereby forming a shrink film section 4 around said containers on the first area 3. Finally, the assembly comprising the packaging and the containers passes through a heating area, for example an oven, in order to proceed with shrinkage of said film around the containers.

Of course the present invention is by no means limited to the embodiments described above and many modifications may be brought thereto without departing from the scope of the appended claims.

The invention claimed is:

1. A shrink packaging provided for packing a plurality of containers arranged in parallel rows, said shrink packaging comprising:

an upper portion;

a lower portion opposite to said upper portion;

at least one first area confined to a top side of said upper portion and arranged to cover an upper portion of said containers, in particular at their opening, said first area comprising a central area surrounded by a peripheral area;

at least one incision line comprising a series of perforations forming at least one partly detachable packaging section arranged for extracting in a direction from said lower portion to said upper portion, each of said at least one incision line entirely within said first area, said partly detachable packaging section having a size greater than or equal to a cross-sectional size of at least one container to accommodate extraction of said at least one container, said at least partly detachable packaging section being localized at a periphery of said central area of said first area, said at least partly detachable part completely exposed on a top of said at least one first area.

2. The packaging according to claim 1, wherein said partly detachable packaging section is totally detachable.

3. The packaging according to claim 1, wherein said peripheral area of said first area covers at least one row of containers on either side of said central area.

4. The packaging according to claim 1, wherein said incision line at the periphery of said central area of said first area comprises an initiating portion arranged for facilitating the initiation of said partly detachable packaging section.

5. The packaging according to claim 1, wherein said incision line has a circular, oval, linear, circular arc, square shape with rounded apices, a rectangular shape with rounded apices, a hexagonal shape with rounded apices or further a finite curved line of irregular shape, allowing extraction of said container out of said partly detachable packaging section.

6. The packaging according to claim 1, wherein said containers are selected from the group consisting of cans, food cans, glass jars, cardboard boxes of the carton or Tetrapack® type.

7. The packaging according to claim 1, wherein a row of containers contains at least two containers.

8. A shrink packaging blank provided for packing a plurality of containers arranged in parallel rows, said shrink packaging comprising:

an upper portion;

a lower portion opposite to said upper portion;

at least one first area confined to a top side of said upper portion and arranged to cover an upper portion of said containers, in particular at their opening, said first area comprising a central area surrounded by a peripheral area;

at least one incision line comprising a series of perforations forming at least one partly detachable packaging section arranged for extracting in a direction from said lower portion to said upper portion, each of said at least one incision line entirely within said first area, said partly detachable packaging section having a size greater than or equal to a cross-sectional size of at least one container to accommodate extraction of said at least one container, said at least one partly detachable packaging section being localized at a periphery of said central area of said first area, said at least one partly detachable packaging section completely exposed on a top of said at least one first area.

9. The packaging blank according to claim 8, wherein said partly detachable packaging section is totally detachable.

10. The packaging blank according to claim 8, wherein said incision line at the periphery of said central area of said first area comprises an initiating portion arranged for facilitating initiation of the film.

11. The packaging blank according to claim 8, wherein said incision line has a circular, oval, linear, circular arc, square shape with rounded apices, a rectangular shape with rounded apices, a hexagonal shape with rounded apices or further a finite curved line of irregular shape, allowing extraction from said container out of said partly detachable packaging section.

12. The packaging plank according to claim 8, wherein said containers are selected from the group consisting of cans, food cans, glass jars, cardboard boxes of the carton or Tetrapack® type.

13. The packaging blank according to claim 8, wherein a row of containers contains at least two containers.

14. An assembly comprising a shrink packaging according to claim 1 and a series of containers arranged in rows parallel with each other.

* * * * *